US011142927B2

(12) United States Patent
Root et al.

(10) Patent No.: US 11,142,927 B2
(45) Date of Patent: Oct. 12, 2021

(54) DOOR LOCKING APPARATUS

(71) Applicant: Katerra Inc., Menlo Park, CA (US)

(72) Inventors: Will Root, Seattle, WA (US); Michael Martin Uhl, Seattle, WA (US); Alex Couweleers, Seattle, WA (US)

(73) Assignee: Katerra Inc., Menlo Park, CA (US)

( * ) Notice: Subject to any disclaimer, the term of this patent is extended or adjusted under 35 U.S.C. 154(b) by 357 days.

(21) Appl. No.: 16/245,066

(22) Filed: Jan. 10, 2019

(65) Prior Publication Data

US 2020/0224458 A1 Jul. 16, 2020

(51) Int. Cl.

| | |
|---|---|
| ***E05B 65/08*** | (2006.01) |
| ***E05B 1/00*** | (2006.01) |
| ***E05B 15/04*** | (2006.01) |
| ***E05C 9/02*** | (2006.01) |
| ***E05C 9/18*** | (2006.01) |

(52) U.S. Cl.

CPC ..... *E05B 65/087* (2013.01); *E05C 9/028* (2013.01); *E05C 9/1841* (2013.01)

(58) Field of Classification Search

CPC ..... E05B 65/087; E05B 2015/0458; E05B 15/0053; E05B 1/0046; E05B 65/0811; E05B 65/08; E05B 2065/0805; E05C 9/028; E05C 9/1841

USPC ..... 70/95–100; 292/98, 124, 132, 197, 224, 292/234, DIG. 46

See application file for complete search history.

(56) References Cited

U.S. PATENT DOCUMENTS

| | | | | | |
|---|---|---|---|---|---|
| 810,927 | A * | 1/1906 | Emmert | | |
| 2,742,309 | A * | 4/1956 | Hillgren | E05B 65/0811 | 292/100 |
| 2,789,852 | A * | 4/1957 | Eads | E05B 65/0817 | 292/110 |
| 2,980,458 | A * | 4/1961 | Russell | E05B 65/0817 | 292/113 |
| 2,983,000 | A * | 5/1961 | Metzger | E05B 65/0811 | 49/35 |
| 3,019,043 | A * | 1/1962 | Woodworth | E05B 65/0817 | 292/113 |
| 3,041,097 | A * | 6/1962 | Eads | E05B 65/0817 | 292/113 |
| 3,065,985 | A * | 11/1962 | Du Four | E05B 65/0811 | 292/103 |

(Continued)

OTHER PUBLICATIONS

International Search Report and Written Opinion of the International Searching Authority for PCT International Application No. PCT/US2020/013032 dated Apr. 30, 2020.

*Primary Examiner* — Lloyd A Gall
(74) *Attorney, Agent, or Firm* — Volpe Koenig

(57) ABSTRACT

A door locking apparatus is provided including a first plate, a second plate, a front assembly, a lock clip, and at least one control. The first plate includes at least one vertical slot. The lock clip is rotatably attached to the front assembly and includes at least one horizontal slot in a first end. The at least one control is mounted to the first plate and includes at least one protrusion. The at least one protrusion projects through the at least on vertical slot and through the at least one horizontal slot. The at least one control moves vertically between a first position and a second position. The lock clip is in an open position when the at least one control is in the first position and a locked position when the at least one control is in the second position.

16 Claims, 11 Drawing Sheets

(56) References Cited

U.S. PATENT DOCUMENTS

| | | | | |
|---|---|---|---|---|
| 3,437,364 | A * | 4/1969 | Walters | E05B 65/0817 292/113 |
| 4,024,739 | A | 5/1977 | Kaufman | |
| 4,436,329 | A | 3/1984 | Metzger | |
| 4,480,862 | A | 11/1984 | Fleming | |
| 4,754,624 | A | 7/1988 | Fleming et al. | |
| 4,790,157 | A | 12/1988 | Lin | |
| 5,152,561 | A | 10/1992 | Engebretson | |
| 5,421,627 | A | 6/1995 | Yane | |
| 5,511,833 | A | 4/1996 | Tashman et al. | |
| 5,676,408 | A | 10/1997 | Davidian | |
| 6,019,401 | A | 2/2000 | Prevot et al. | |
| 6,585,301 | B1 | 7/2003 | Prevot et al. | |
| 7,373,794 | B1 | 5/2008 | Depass | |
| 7,695,030 | B2 | 4/2010 | Balbo Di Vinadio | |
| 7,837,241 | B2 * | 11/2010 | Chung | E05B 65/0811 292/199 |
| 8,186,189 | B2 * | 5/2012 | Brisco | E05B 65/0811 70/100 |
| 8,517,434 | B1 | 8/2013 | Reep, Sr. | |
| 9,091,103 | B2 | 7/2015 | Buzz, III | |
| 9,097,038 | B1 | 8/2015 | Cohen | |
| 9,371,673 | B2 | 6/2016 | Nichol | |
| 9,482,035 | B2 | 11/2016 | Wolf | |
| 9,580,931 | B2 | 2/2017 | Myers et al. | |
| 2006/0082166 | A1 | 4/2006 | Lawrence | |
| 2006/0192396 | A1 * | 8/2006 | Frolov | E05C 1/163 292/169 |
| 2013/0200636 | A1 * | 8/2013 | Hagemeyer | E05B 1/00 292/202 |
| 2017/0335597 | A1 * | 11/2017 | Lin | E05B 1/0015 |

* cited by examiner

DOOR LOCKING APPARATUS

BACKGROUND

A pocket door is a sliding door that, when open, slides into a compartment in the adjacent wall. Because a pocket door does not swing into the room, the pocket door is a favored alternative for tight spaces. The pocket door's space saving feature has made it a popular door option for bathrooms, closets, laundry rooms, utility rooms, and home offices. The latching and locking apparatus of a pocket door must allow the door to slide into narrow spaces, such as the compartment in the adjacent wall, and thus, requires minimal projection from the door's face. Because of this requirement, the hardware options for pocket doors are limited.

SUMMARY

A door locking apparatus is provided including a first plate, a second plate, a front assembly, a lock clip, and at least one control. The first plate includes at least one vertical slot. The lock clip is rotatably attached to the front assembly and includes at least one horizontal slot in a first end. The at least one control is mounted to the first plate and includes at least one protrusion. The at least one protrusion projects through the at least one vertical slot in the first plate and through the at least one horizontal slot in the first end of the lock clip. The at least one control moves vertically between a first position and a second position. The lock clip is in an open position when the at least one control is in the first position and a locked position when the at least one control is in the second position. The vertical movement of the at least one control rotates the lock clip. The lock clip is actuated without requiring a rotary motion of the at least one control, which makes the door locking apparatus compliant with the American with Disabilities Act (ADA).

In one embodiment, the first position of the at least one control is a lower position, and the second position is an upper position. Alternatively, the first position of the at least one control is an upper position, and the second position is a lower position.

The door locking apparatus may also include a spring to hold the lock clip in the locked position. The door locking apparatus may also include a strike plate.

The lock clip of the door locking apparatus may include a second end. The lock clip may be rotatably attached between the first end and the second end. When the at least one control is in the first position, the first end is lowered and the second end is raised. When the at least one control is in the second position, the first end is raised and the second end is lowered.

A door assembly is also provided including a door and a door locking apparatus attached to the door. The door locking apparatus includes the same details and embodiments previously discussed. In one embodiment, the door is a pocket door. The door may include a lockset bore and a latchbolt bore. The front assembly is attached to the latchbolt bore, and the first plate and the second plate are attached to the lockset bore on opposing sides.

BRIEF DESCRIPTION OF THE DRAWINGS

The foregoing summary, as well as the following detailed description will be better understood when read in conjunction with the appended drawings. For the purpose of illustration, there is shown in the drawings different embodiments. It should be understood, however, that the teachings are not limited to the precise door locking apparatus shown.

DETAILED DESCRIPTION

Figure 1:
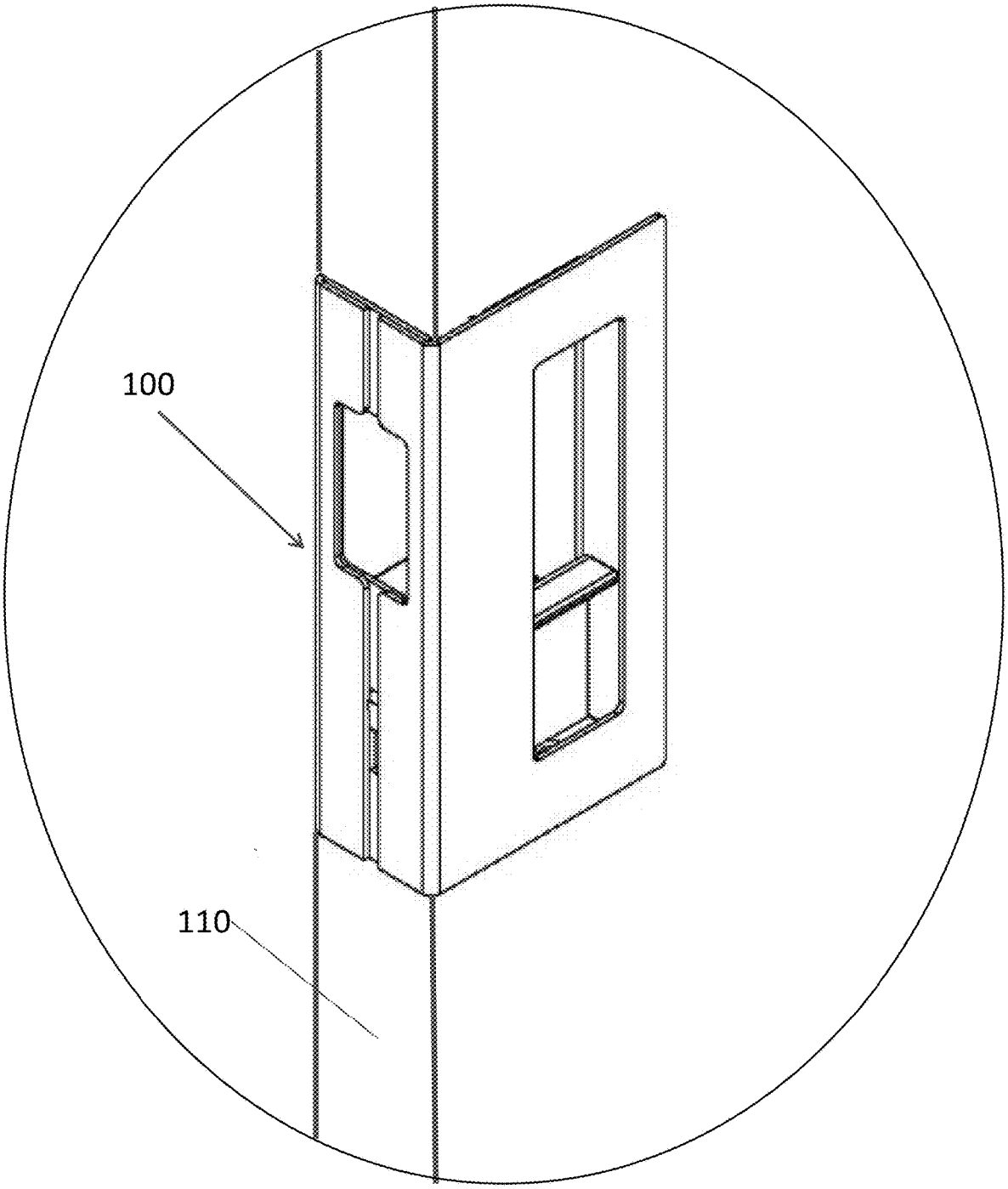
FIG. 1 is a magnified view of a door locking apparatus and a door.

For purposes of this detailed description, words such as "front," "back," "top," "bottom," "left," and "right" designate directions in the drawings, and are used for convenience in referring to the designated parts or areas. The use of the terminology "at least one of" followed by a list of elements, such as "A, B, or C," means A, B, or C individually or various combinations thereof.

As shown in the magnified view in FIG. 1, a door locking apparatus 100 that locks a door 110 is provided. As described in further detail herein, the door locking apparatus 100 is attached to the door 110. In one embodiment, the door 110 is a pocket door. However, the design of the door locking apparatus 100 can accommodate any door. Moreover, the door 110 includes a lockset bore and a latchbolt bore (not visible in FIG. 1) to install the door locking apparatus 100.

Figure 2:
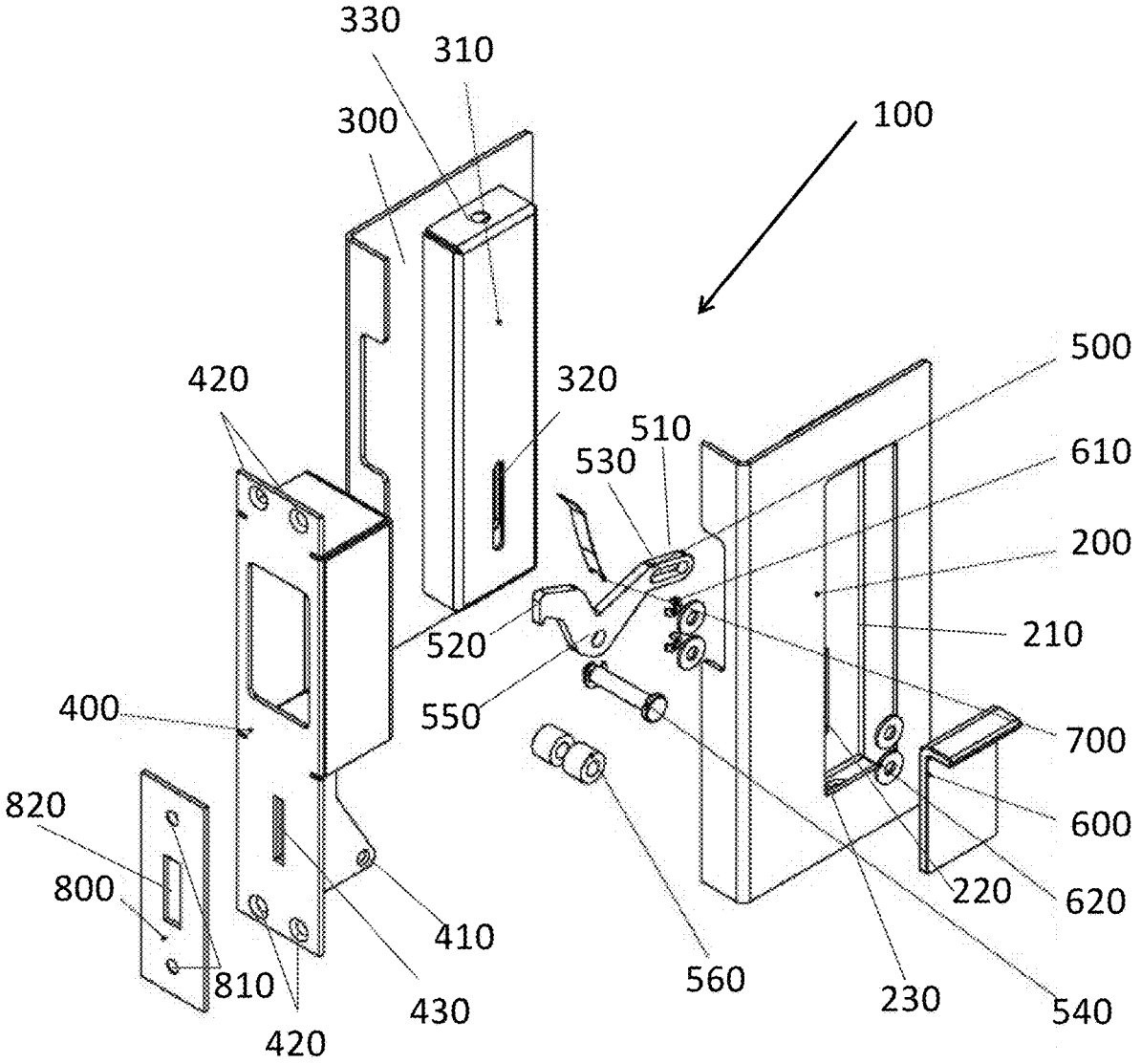
FIG. 2 is an exploded view of the door locking apparatus.

FIG. 2 depicts an exploded view of the door locking apparatus 100. As shown in FIG. 2, the door locking apparatus 100 includes a first plate 200, a second plate 300, a front assembly 400, a lock clip 500, and at least one control 600. As depicted in FIG. 2, the first plate 200 and the second plate 300 are mirror images of each other. The first plate 200 and second plate 300 may also each include an inset portion 210, 310 to allow a hand or fingers to easily push or pull the door locking apparatus 100 and thereby slide the door 110. The inset portions 210, 310 of the plates 200, 300 fit in the lockset bore of the door 110. The first plate 200 and the second plate 300 may also include apertures 230, 330 in the top and bottom ledges of the inset portions 210, 310. These apertures 210, 310 allow the plates 200, 300 to be attached to the door with hardware such as screws. The placement of the apertures 230, 330 in the inset portion 210, 310 hides the hardware (not shown) used to attach the plates 200, 300 to the door and provides a smooth finished outer appearance. The first plate 200 also includes a vertical slot 220. The second plate may also include a vertical slot 320. As described in more detail herein, the vertical slot 220 in the first plate 200 is used to mount the control 600 to the first plate 200.

FIG. 2 also depicts a front assembly 400. The front assembly 400 includes at least one aperture 410 to rotatably attach the lock clip 500. The back portion of the front assembly 400 fits in the latchbolt bore of the door 110. The front assembly 400 may include additional apertures 420 on the front face of the front assembly 400 to attach the front assembly 400 to the surface of the door 110 surrounding the latchbolt bore. The front assembly 400 also includes a slot 430 to allow the lock clip 500 to extend there through.

FIG. 2 also shows the lock clip 500. The lock clip 500 includes a first end 510 and a second end 520. The first end 510 of the lock clip 500 includes a horizontal slot 530. As shown in FIG. 2, the second end 520 of the lock clip 500 may be hooked shaped. The lock clip 500 rotatably attaches to the front assembly 400 via a pin 540. The lock clip 500 is rotatably attached to the front assembly 400 by aligning an aperture 550 in the lock clip 500 with the apertures 410 in the front assembly 400. Then, the pin 540 in slid through the aligned apertures 550, 410. The lock clip 500 and front assembly 400 attachment may also include spacers 560 between the ends of the pin 540 and the lock clip 500. As the lock clip 500 is rotated towards the front assembly 400, the second end 520 of the lock clip 500 protrudes through the slot 430 in the front assembly 400. When the lock clip 500 is rotated away from the front assembly 400, the second end 520 retracts through the slot 430.

FIG. 2 also shows the control 600 of the door locking apparatus 100. The control 600 includes protrusions 630 that project from the back of the control 600 (not visible in FIG. 2). The control 600 slidably mounts to the first plate 200. The control 600 is mounted by inserting the protrusions 630 through the vertical slot 220 of the first plate 200. After the protrusions are slid through the vertical slot 220, the control 600 is loosely held in place by engaging retaining rings 610 on the ends of the protrusions 630. The protrusion 630 and slot 220 connection allows the control 600 to move vertically the length of the slot 220. The connection may also include washers 620 between the control 600 and the surface of the first plate 200. By creating distance between the control 600 and the surface of the first plate 200, the washers 620 allow the control 600 to move smoothly upwards and downwards.

As shown in FIG. 2, the door locking apparatus 100 also includes a spring 700. The top end of the spring 700 attaches to the front assembly 400.

As shown in FIG. 2, the door locking apparatus 100 may also include a strike plate 800. The strike plate 800 includes apertures 810 to attach the strike plate 800 to a surface opposing the front assembly 400, such as the door jamb. The strike plate 800 also includes a slot 820. The slot 820 of the strike plate 800 aligns with the slot 430 in the front assembly 400. When the second end 520 of the lock clip 500 rotates and extends through the slot 430 of the front assembly 400 to a locked position, the hooked shaped second end 520 latches onto the bottom edge of the slot 820 in the strike plate 800.

The components of the door locking apparatus 100 may be made from any structurally rigid material such as metal or hard plastic. Additionally, the components may include a coating to allow for a variety of finished looks.

Figure 3:
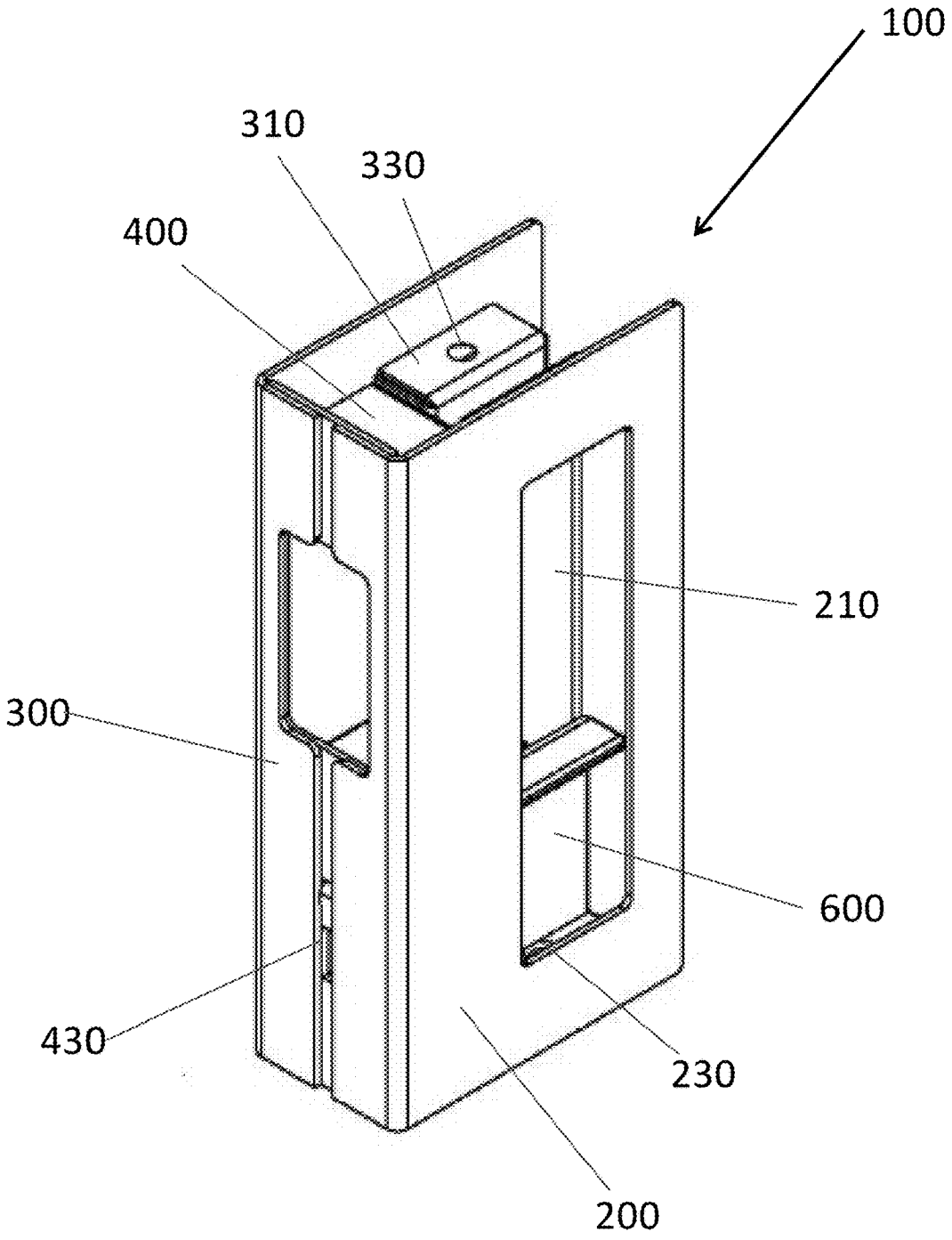
FIG. 3 is a perspective view of the door locking apparatus.

FIG. 3 depicts a perspective view of the assembled door locking apparatus 100. FIG. 3 shows the control 600 mounted to the first plate 200. As shown in FIG. 3, when assembled, the front assembly 400 is substantially enclosed by the first plate 200 and the second plate 300. However, as shown in FIG. 3, a space remains between the front of the first plate 200 and the second plate 300 to allow the lock clip 500 to protrude through the slot 430 and out past the front of the first plate 200 and second plate 300.

Figure 4:
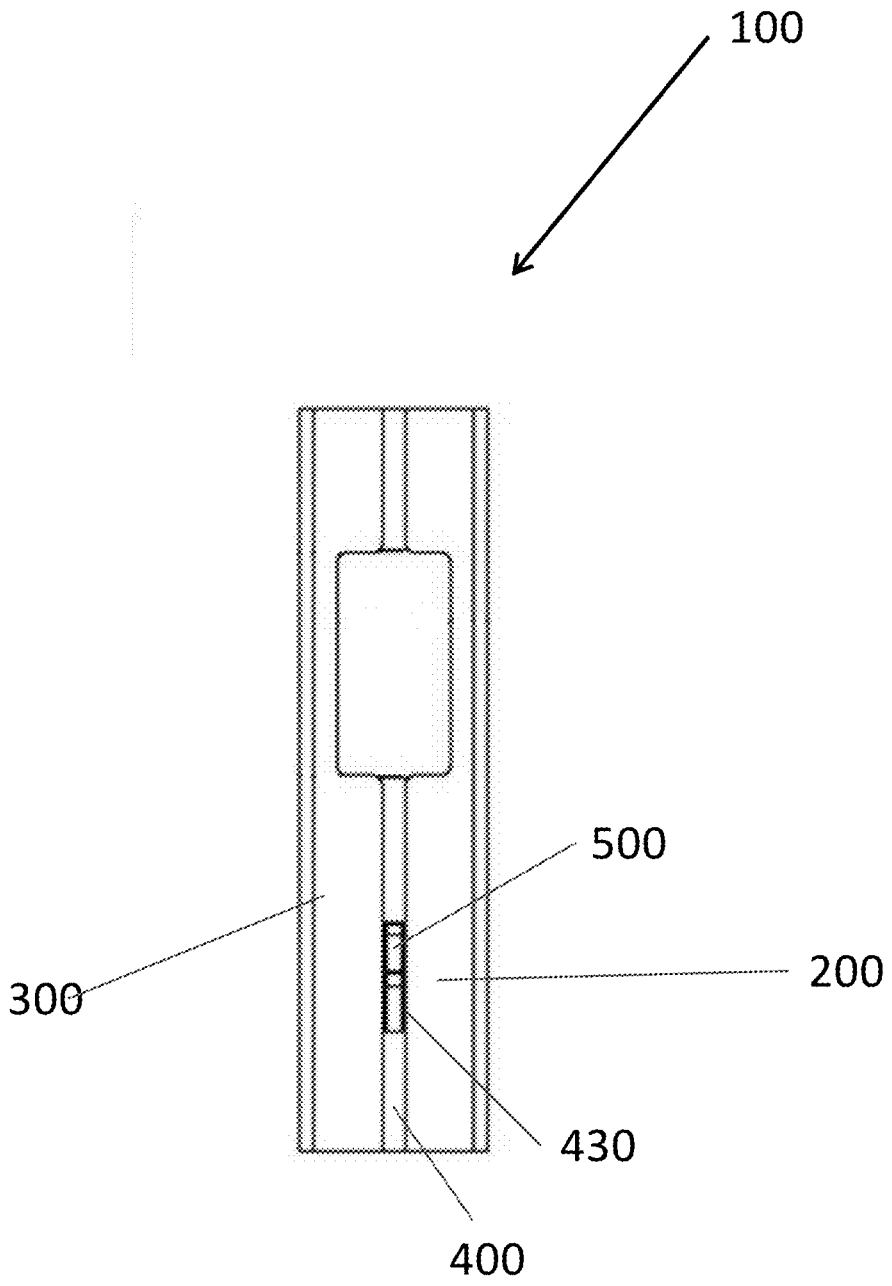
FIG. 4 is a front view of the door locking apparatus.

FIG. 4 depicts a front view of the assembled door locking apparatus 100. As previously discussed, FIG. 4 shows the space between the front of the first plate 200 and the front of the second plate 300. As shown, the lock clip 500 aligns with the slot 430 in the front assembly 400.

Figure 5:
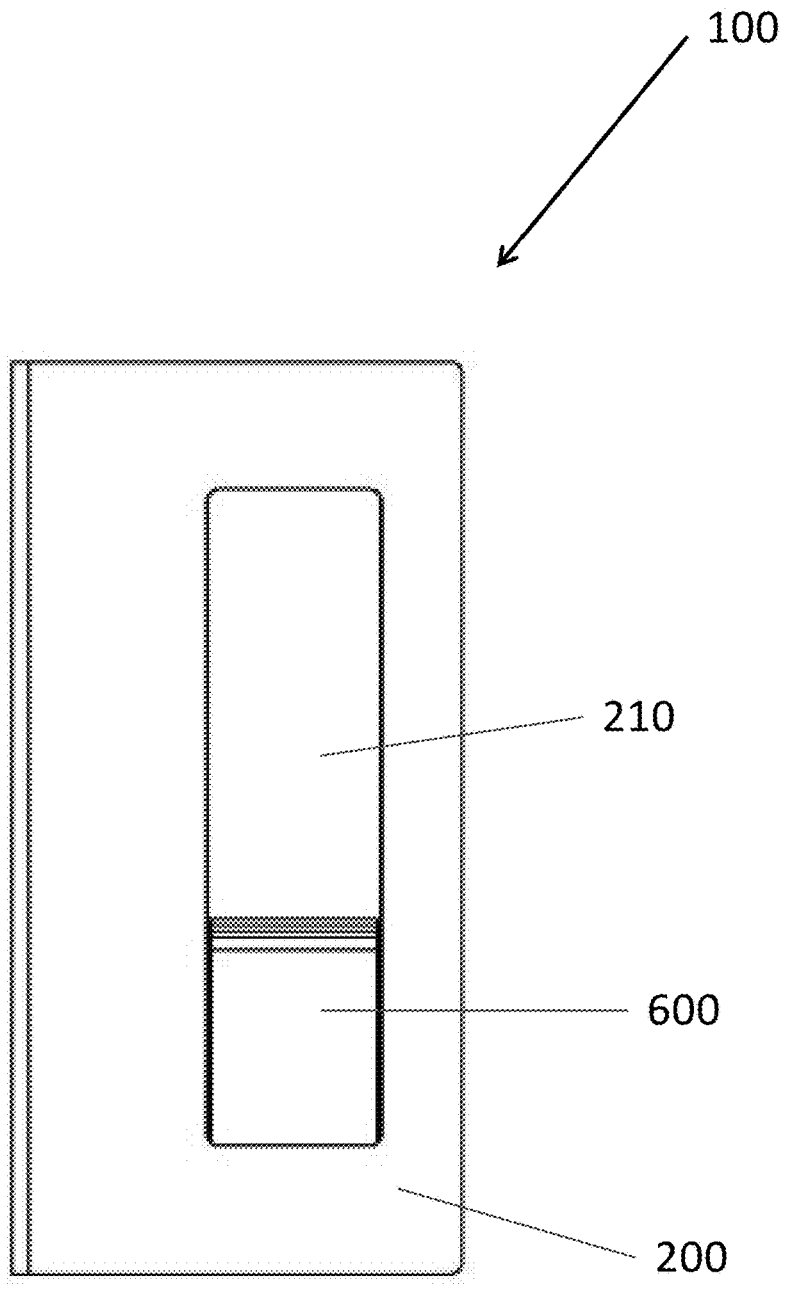
FIG. 5 is a left side view of the door locking apparatus.

FIG. 5 is an elevation view looking at the first plate 200 of the assembled door locking apparatus 100. FIG. 5 shows a front view of the control 600 mounted to the first plate 200.

Figure 6:
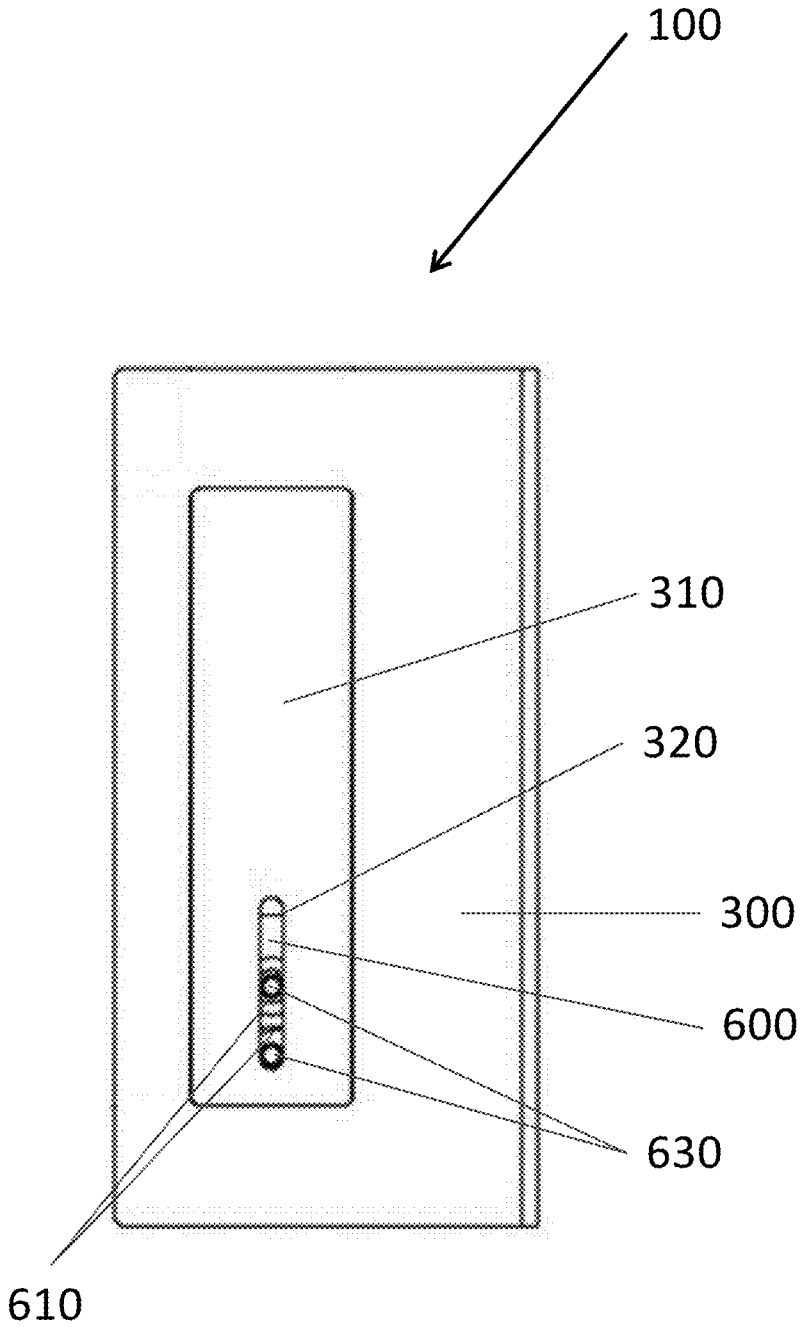
FIG. 6 is a right side view of the door locking apparatus.

FIG. 6 is an elevation view looking at the second plate 300 of the assembled door locking apparatus 100. The back of the control 600 is visible through the slot 320 in the second plate 300. Additionally, the ends of the protrusions 630 and the retaining rings 610 are visible through the slot 320. Alternatively, the second plate 300 may not have a slot 320.

Figure 7:
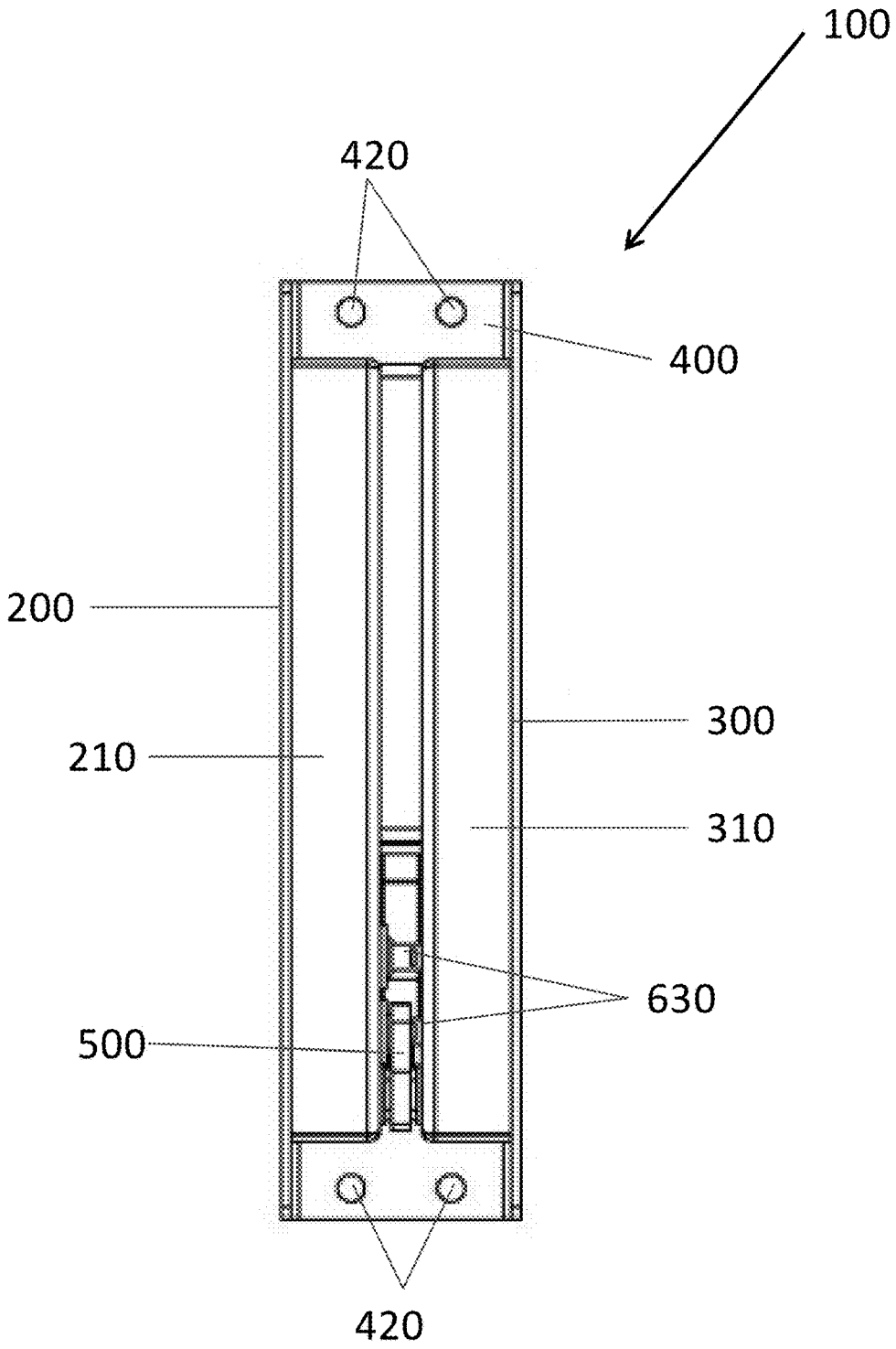
FIG. 7 is a rear view of the door locking apparatus.

FIG. 7 is a rear view of the assembled door locking apparatus 100. FIG. 7 illustrates two protrusions 630 of the control 600 extending through the back of the inset portion 210 of the first plate 200. One of the two protrusions 630 extends through the lock clip 500.

Figure 8:
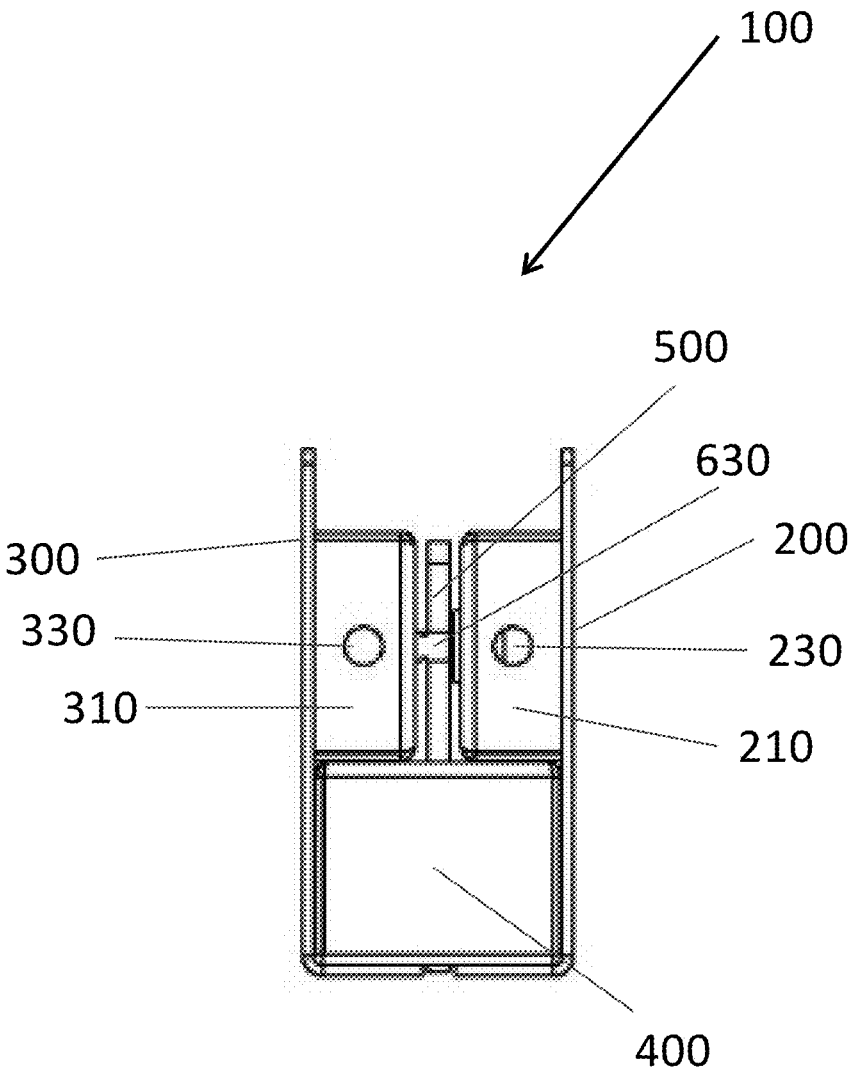
FIG. 8 is a top view of the door locking apparatus.

FIG. 8 shows a top view of the assembled door locking apparatus 100.

Figure 9:
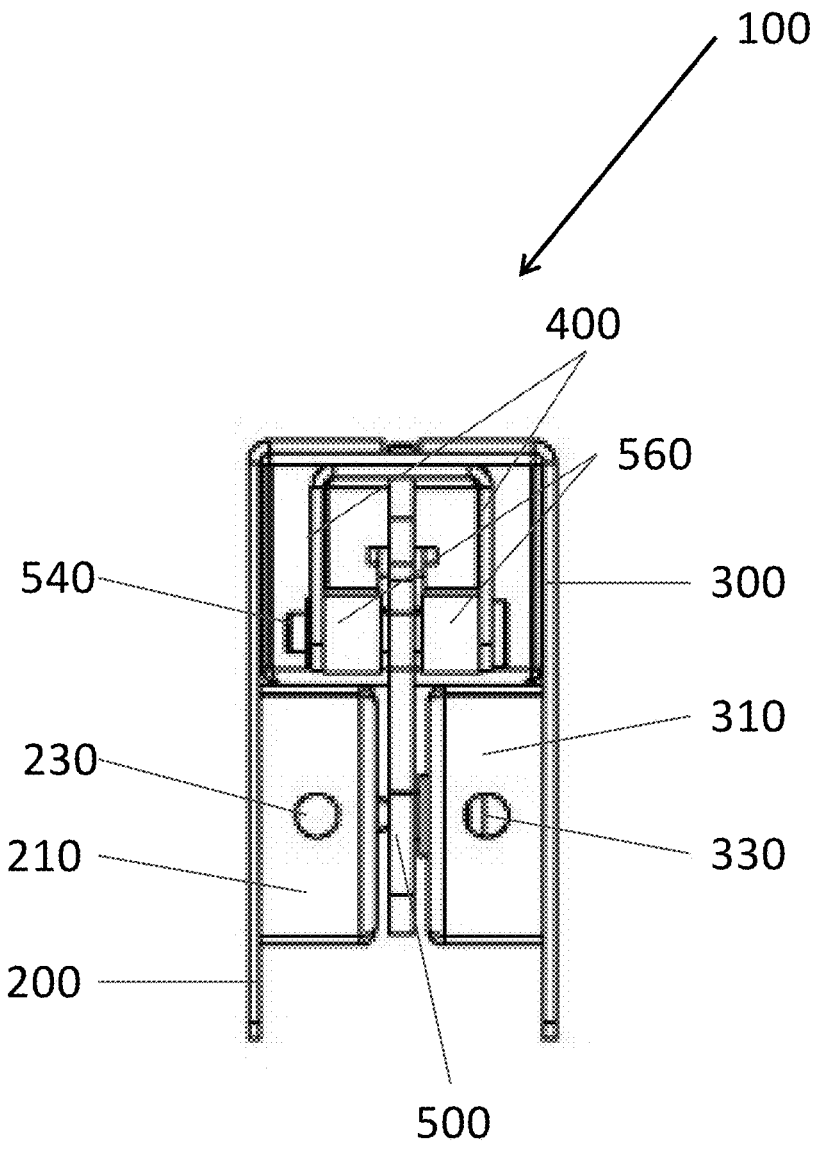
FIG. 9 is a bottom view of the door locking apparatus.

FIG. 9 shows a bottom view of the assembled door locking apparatus 100. FIG. 9 illustrates the lock clip 500 and front assembly 400 attachment. As shown, the pin 540 extends through two legs of the front assembly 400 and the lock clip 500. FIG. 9 also shows two spacers 560 between the lock clip 500 and the two legs of the front assembly 400.

Figure 10:
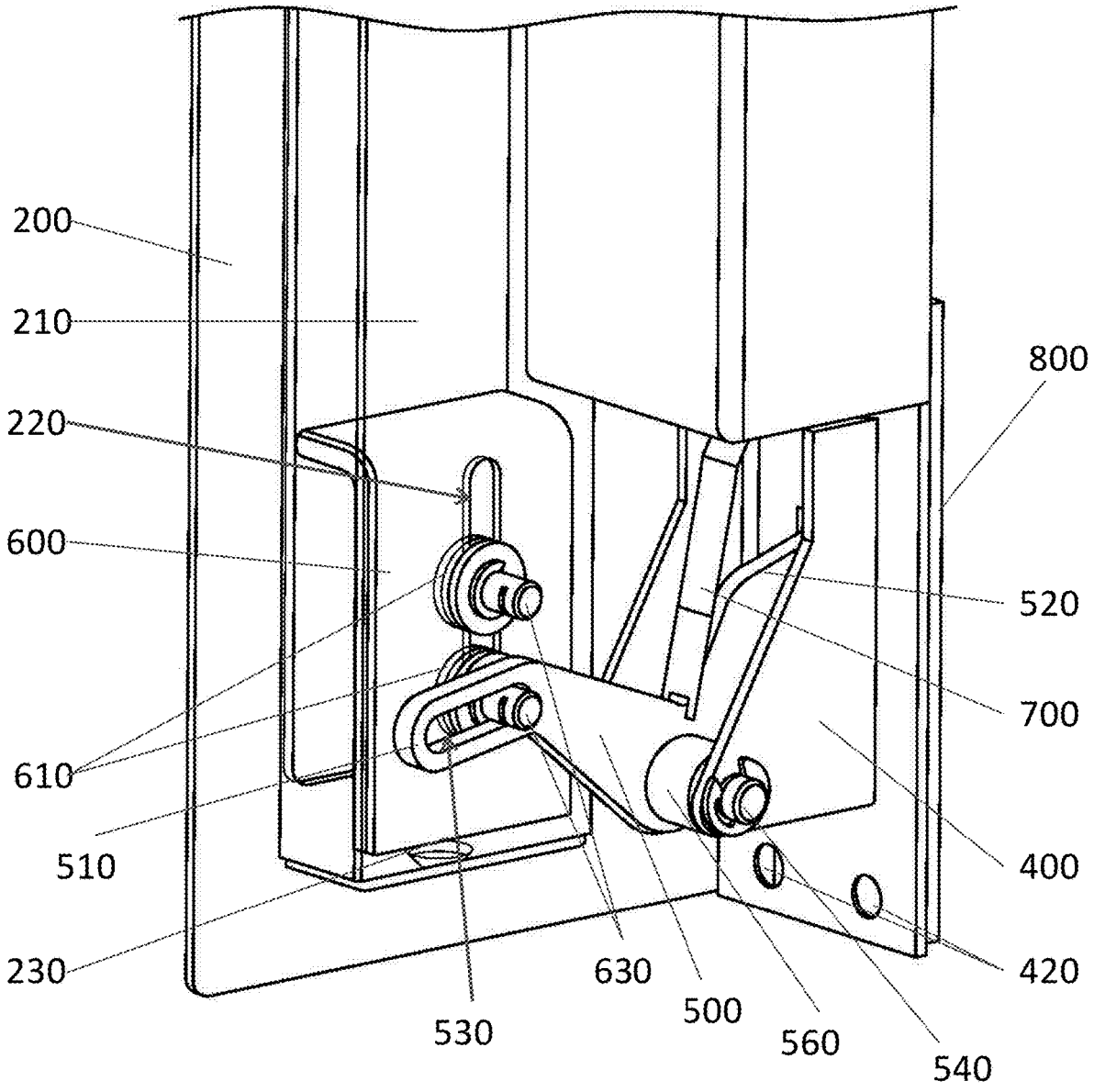
FIG. 10 is a section view of the back of the first plate and the front assembly showing the lock clip in the open position.
Figure 11:
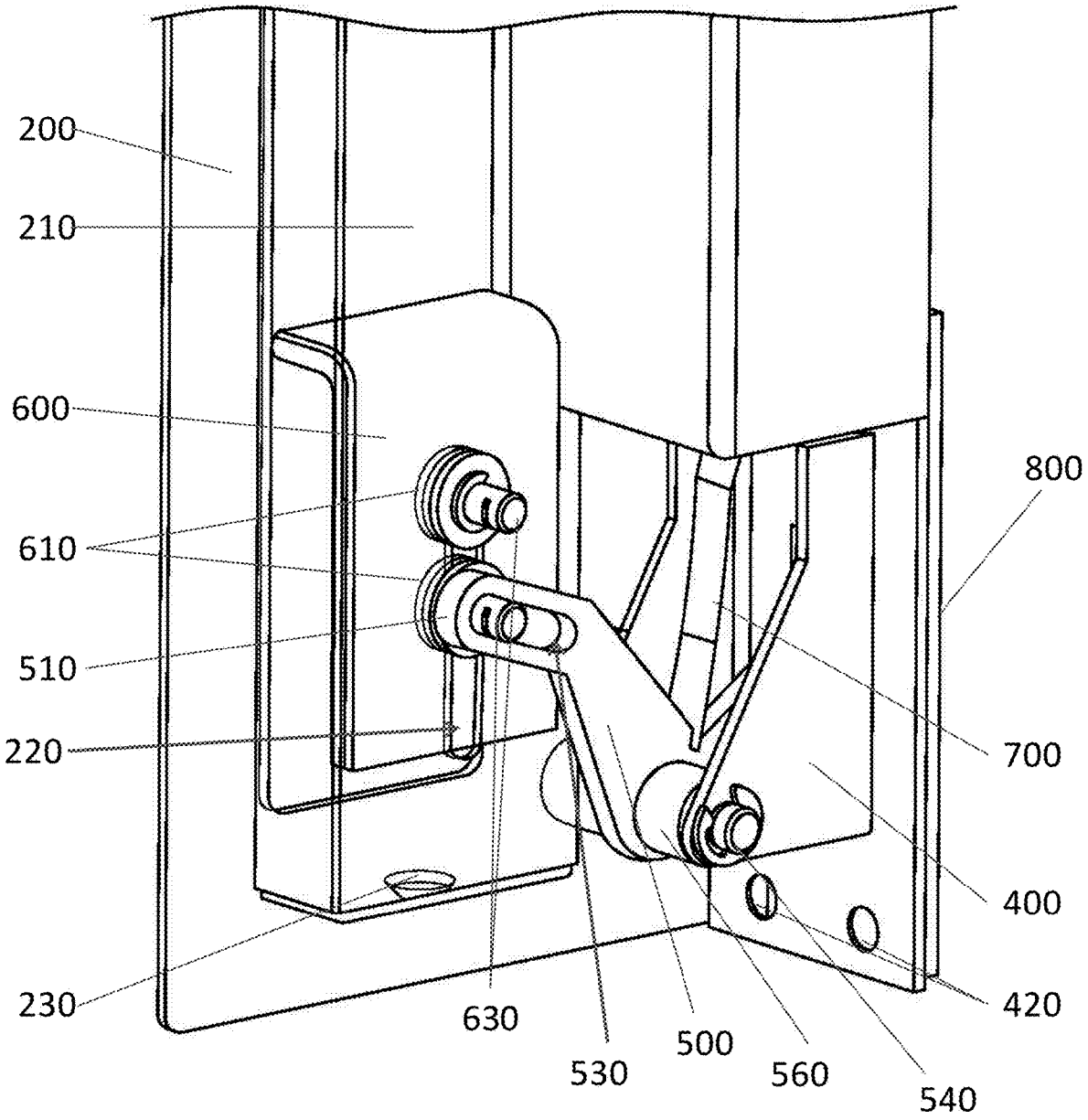
FIG. 11 is a section view of the back of the first plate and the front assembly showing the lock clip in the locked position.

FIGS. 10-11 show a section view of the inside of the door locking apparatus 100. FIG. 10 shows the lock clip 500 in an open position, while FIG. 11 shows the lock clip 500 in the locked position. As explained previously, the control 600 moves vertically. The control 600 moves between a first position in which the lock clip 500 is in an open position and a second position in which the lock clip 500 is in a locked position.

As shown in FIG. 10, the lock clip 500 is in the open position. In the embodiment depicted in FIG. 10, the control 600 is in a lower position. As shown in FIG. 10, a protrusion 630 of the control 600 projects through the vertical slot 220 of the first plate 200 and the horizontal slot 530 in the first end 510 of the lock clip 500. In the open position, the first end 510 of the lock clip 500 is lowered and the second end 520 of the lock clip 500 is raised. The top end of the spring 700 is attached to the front assembly 400 and the bottom end of the spring 700 rests on the lock clip 500.

When the control 600 is raised vertically to an upper position, as shown in FIG. 11, the protrusion 630 of the control 600 slides along the horizontal slot 530 and rotates the lock clip 500 to the locked position. This rotation raises the first end 510 of the lock clip 500 and lowers the second end 520 of the lock clip 500. Lowering the second end 520 of the lock clip 600 allows the hooked shaped end to extend through the slot 430 (not visible) in the front assembly 400 and latch onto the strike plate 800. In the locked position, the spring 700 engages with the lock clip 500 and flexes. When the spring 700 is engaged, the lock clip 500 is held in the locked position until the control 600 is lowered. The control 600 can repeatedly be raised and lowered to lock and unlock the door locking apparatus 100.

Alternatively, the door locking apparatus 100 may be designed so that the lock clip 500 is in the open position when the control 600 is in the upper position and in the locked position when the control 600 is in the lower position.

Having thus described in detail a preferred selection of embodiments of the present invention, it is to be appreciated and will be apparent to those skilled in the art that many physical changes could be made to the door locking apparatus 100 without altering the inventive concepts and principles embodied therein. The present embodiments are therefore to be considered in all respects as illustrative and not restrictive, the scope of the invention being indicated by the appended claims rather than by the foregoing description, and all changes which come within the meaning and range of equivalency of the claims are therefore to be embraced therein.

What is claimed is:

1. A door locking apparatus comprising:

a first plate including at least one first straight slot;

a second plate;

a front assembly;

a V-shaped lock clip rotatably attached to the front assembly, the lock clip including at least one second straight slot in a first end; and at least one control mounted to the first plate, the at least one control including at least one protrusion projecting through the at least one first straight slot and the at least one second straight slot;

wherein the at least one control is configured to move vertically between a first position and a second position;

wherein the lock clip is in an open position when the at least one control is in the first position and a locked position when the at least one control is in the second position.

2. The door locking apparatus of claim 1 wherein the first position is a lower position and the second position is an upper position.

3. The door locking apparatus of claim 1 further including a spring to hold the lock clip in the locked position.

4. The door locking apparatus of claim 1 further including a strike plate.

5. The door locking apparatus of claim 1 wherein the lock clip further includes a second end.

6. The door locking apparatus of claim 5 wherein the lock clip is rotatably attached between the first end and the second end.

7. The door locking apparatus of claim 6 wherein the first end is lowered and the second end is raised when the at least one control is in the first position.

8. The door locking apparatus of claim 6 wherein the first end is raised and the second end is lowered when the at least one control is in the second position.

9. A door assembly comprising:

a door; and a door locking apparatus attached to the door, the door locking apparatus including:

a first plate including at least one first straight slot;

a second plate;

a front assembly;

a V-shaped lock clip rotatably attached to the front assembly, the lock clip including at least one second straight slot in a first end; and at least one control mounted to the first plate, the at least one control including at least one protrusion projecting through the at least one first straight slot and the at least one second straight slot;

wherein the at least one control is configured to move vertically between a first position and a second position;

wherein the lock clip is in an open position when the at least one control is in the first position and a locked position when the at least one control is in the second position.

10. The door assembly of claim 9 wherein the door is a pocket door.

11. The door assembly of claim 9 wherein the first position is a lower position and the second position is an upper position.

12. The door assembly of claim 9 further including a spring to hold the lock clip in the locked position.

13. The door assembly of claim 9 wherein the lock clip further includes a second end.

14. The door assembly of claim 13 wherein the lock clip is rotatably attached between the first end and the second end.

15. The door assembly of claim 14 wherein the first end is lowered and the second end is raised when the at least one control is in the first position.

16. The door assembly of claim 14 wherein the first end is raised and the second end is lowered when the at least one control is in the second position.

* * * * *